US005706550A

United States Patent [19]

Holsten et al.

[11] Patent Number: 5,706,550

[45] Date of Patent: Jan. 13, 1998

[54] FLOOR BRUSH NOZZLE ASSEMBLY

[75] Inventors: Stuart V. Holsten, O'Fallon; Jeffrey L. Young, St. Peters, both of Mo.

[73] Assignee: Emerson Electric Co., St. Louis, Mo.

[21] Appl. No.: 582,903

[22] Filed: Jan. 4, 1996

[51] Int. Cl.[6] ..... A47L 9/06

[52] U.S. Cl. ..... 15/400; 15/367

[58] Field of Search ..... 15/398, 399, 400, 15/367, 420, 421

[56] References Cited

U.S. PATENT DOCUMENTS

| | | | |
|---|---|---|---|
| 2,747,217 | 5/1956 | Stahl | 15/399 X |
| 2,814,066 | 11/1957 | Lesh | 15/399 X |
| 3,795,027 | 3/1974 | Lindberg | 15/398 |
| 4,685,170 | 8/1987 | Ahlf et al. | 15/398 X |
| 5,419,007 | 5/1995 | Hult et al. . | |

FOREIGN PATENT DOCUMENTS

| | | | |
|---|---|---|---|
| 504656 | 7/1951 | Belgium | 15/398 |
| 2554340 | 5/1985 | France | 15/398 |

*Primary Examiner*—Chris K. Moore

*Attorney, Agent, or Firm*—Polster, Lieder, Woodruff & Lucchesi

[57] ABSTRACT

A floor brush nozzle assembly for a vacuum cleaner is disclosed. The floor brush nozzle assembly includes an elongated generally rectangular shaped nozzle housing including a connecting passageway for association with the vacuum cleaner. A U-shaped channel surrounds the nozzle housing for receiving an upper formed end of a floor brush. The U-shaped channel includes peripherally spaced ribs that cause a complementary U-shaped formed end of the floor brush to releasably and resiliently engage undercut areas in the U-shaped channel for releasably mounting the floor brush relative to the nozzle housing. The upper formed end of the floor brush may also have an undercut configuration to enhance releasable engagement with the undercut areas in the U-shaped channel. The upper formed end of the floor brush is preferably a metal component while the nozzle housing is a molded plastic component. In order to pick up fine debris as well as larger media such as rocks or wood chips, the floor brush may be provided with shorter leading bristles and longer trailing bristles for this purpose.

12 Claims, 3 Drawing Sheets

FLOOR BRUSH NOZZLE ASSEMBLY

BACKGROUND OF THE INVENTION

The present invention relates to a vacuum cleaner floor nozzle with snap-in brush, and more particularly, to a floor brush nozzle assembly for a vacuum cleaner which includes a floor brush that is releasably engaged relative to the floor brush nozzle.

Functionality, versatility, and economy are the hallmark of new product designs in a variety of fields. The same principles apply to vacuum cleaner floor nozzles, as well.

At present, floor brushes are conventionally mounted in a vacuum cleaner floor nozzle by the use of fasteners or other locking devices. Replacement of such floor brushes requires loosening of the fasteners and subsequent re-tightening after a new brush is substituted. While this is a generally accepted practice, it is more costly to the manufacturer, due to the number of fasteners required and associated assembly time. It would be desirable to use a "snap fit" engagement for holding and retaining a floor brush in a vacuum cleaner floor nozzle; however, up to the present invention, the manufacturing tolerances in the floor brush and the vacuum cleaner floor nozzle have not permitted a "snap fit" engagement to be used. More specifically, the floor brush is typically constructed with a U-shaped metal channel which is crimped to hold one end of the floor brush bristles. Such U-shaped metal channels unfortunately have relatively large manufacturing tolerances. As a result, the vacuum cleaner floor nozzle, typically a molded plastic element, can't be molded with an undercut deep enough to trap the U-shaped metal channel of the floor brush in a secure position for the entire tolerance range of the U-shaped metal channel of the floor brush and the molded vacuum cleaner floor nozzle.

Conventional floor brushes also do not permit floor debris of various sizes to be easily picked up. For example, current floor brushes do not readily permit both fine debris as well as larger media such as rocks or wood chips to be picked up using the same floor brush.

The floor brush nozzle assembly of the present invention has been constructed to overcome the aforementioned problems associated with prior art devices in a new and improved construction which has not been heretofore available.

SUMMARY OF THE INVENTION

Among the several objects and advantages of the present invention include:

The provision of a new and improved floor brush nozzle assembly for use in a vacuum cleaner which includes a snap-in floor brush;

The provision of the aforementioned new and improved floor brush nozzle assembly which is releasably engaged and disengaged relative to the floor brush nozzle without the need for fasteners or other locking devices;

The provision of the aforementioned new and improved floor brush nozzle assembly which facilitates removal and replacement or repositioning of the floor brush depending on the user's cleaning preferences;

The provision of the aforementioned new and improved floor brush nozzle assembly in which the floor brush is constructed for picking up both fine debris as well as larger media such as rocks and wood chips;

The provision of the aforementioned new and improved floor brush nozzle assembly in which the floor brush has shorter leading bristles and longer trailing bristles to facilitate pick-up of different size particles; and The provision of the aforementioned new and improved floor brush nozzle assembly which is durable, economical, versatile, and otherwise well adapted for the purposes intended.

Briefly stated, the floor brush nozzle assembly of the present invention is designed for use with a vacuum cleaner and includes an elongated generally rectangular shaped nozzle housing having a connecting passageway for the vacuum cleaner. A U-shaped channel or opening surrounds the nozzle housing for receiving a complementary U-shaped upper formed end of a floor brush. The U-shaped channel of the nozzle housing includes peripherally spaced ribs that cause the upper formed end of the floor brush to releasably engage undercut areas in the U-shaped channel for maintaining the floor brush in mounted position relative to the nozzle housing.

The complementary U-shaped upper formed end of the floor brush preferably also has an undercut configuration which enhances releasable engagement with the undercut areas in the U-shaped channel of the nozzle housing. The complementary U-shaped upper formed end of the nozzle brush is preferably a metal component while the nozzle housing is preferably a molded plastic component.

The U-shaped channel of the nozzle housing includes inner and outer rings connected by an integral bight end portion, the inner ring being longer than the outer ring. The inner ring of the U-shaped channel includes the peripherally spaced ribs and the outer ring of the U-shaped channel includes the undercut areas. The undercut areas in the U-shaped channel preferably comprise peripherally spaced protuberances.

The floor brush includes shorter leading bristles and longer trailing bristles to facilitate pick-up of both fine debris and larger media such as rocks and wood chips.

These and other objects and advantages of the present invention will become apparent from the description that follows.

BRIEF DESCRIPTION OF THE DRAWINGS

In the drawings.

Corresponding reference numerals will be used throughout the several figures of the drawings.

DESCRIPTION OF THE PREFERRED EMBODIMENTS

The following detailed description illustrates the invention by way of example and not by way limitation. This description will clearly enable one skilled in the art to make and use the invention, and describes several embodiments, adaptions, variations, alternatives and uses of the invention, including what I presently believe is the best mode of carrying out the invention.

Figure 1:
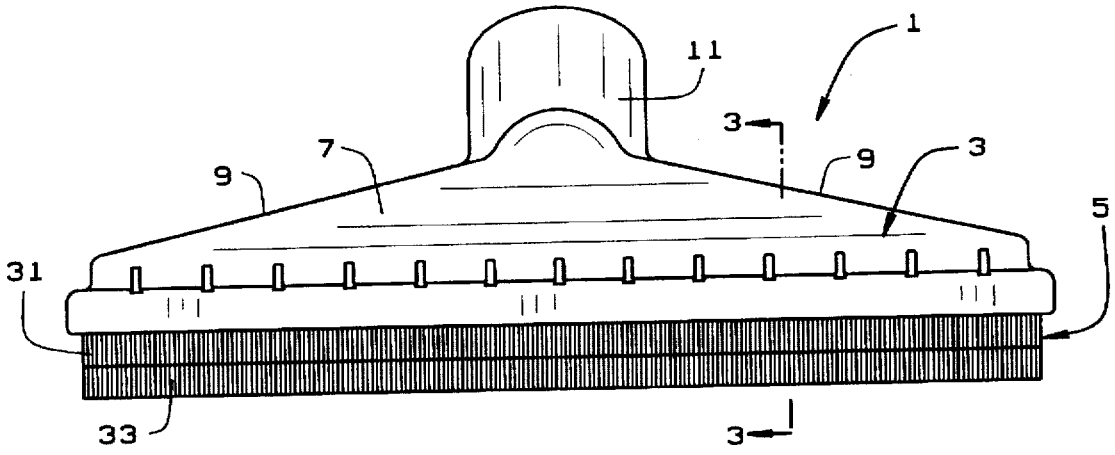
FIG. 1 is a side elevational view of the floor brush nozzle assembly with a releasably mounted floor brush.
Figure 2:
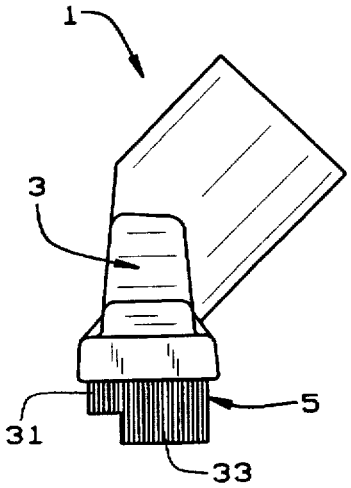
FIG. 2 is a side elevational view of the floor brush nozzle assembly shown in FIG. 1.
Figure 3:
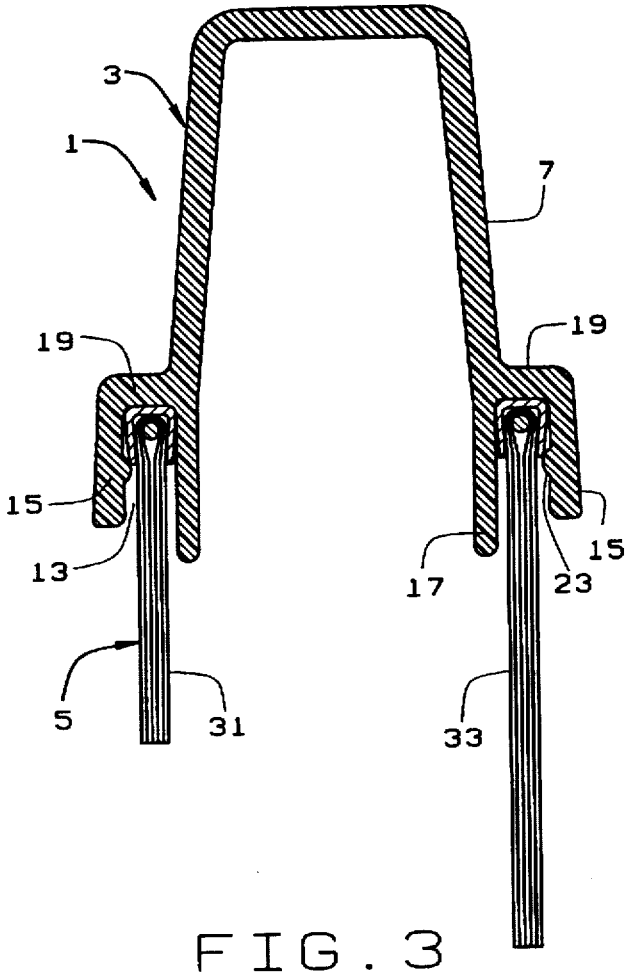
FIG. 3 is an enlarged sectional view of the floor brush nozzle assembly as viewed along lines 3—3 of FIG. 1.
Figure 4:
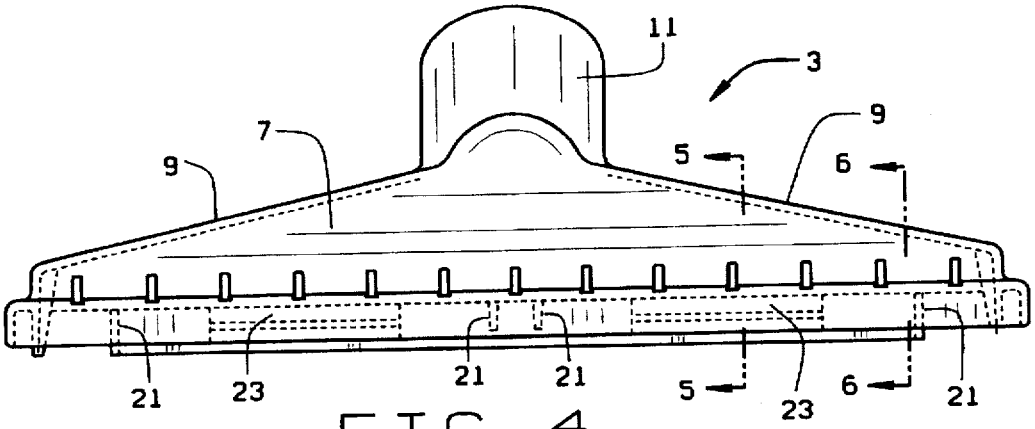
FIG. 4 is a side elevational view of the floor brush nozzle assembly without the floor brush.
Figure 5:
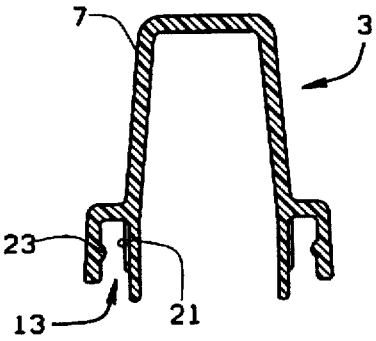
FIG. 5 is a sectional view of the floor brush nozzle as viewed along lines 5—5 of FIG. 4.
Figure 6:
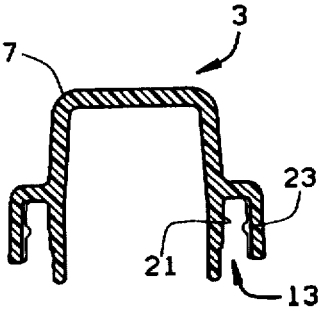
FIG. 6 is a sectional view of the floor brush nozzle as viewed along lines 6—6 of FIG. 4.

As shown in FIGS. 1–3 of the drawings, the floor brush nozzle assembly one of the present invention includes a floor brush nozzle 3 as shown in FIGS. 3–8 of the drawings, and a floor brush 5 as best illustrated in FIGS. 1–2 and 9–10 of the drawings.

Figure 8:
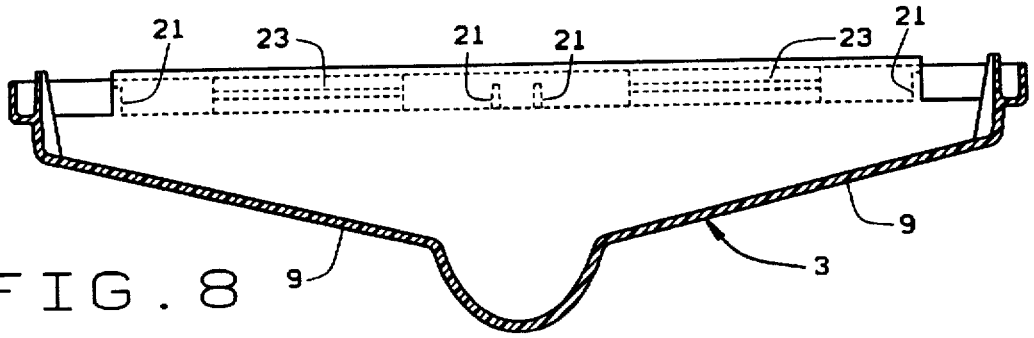
FIG. 8 is a sectional view of the floor brush nozzle as viewed along lines 9—9 of FIG. 7.

The floor brush nozzle 3 includes an elongated housing 7 with upper outwardly tapering walls 9, 9, as best seen in FIG. 8 of the drawings. An integral cylindrical section 11 is connected to the elongated housing 7 and includes a connecting passageway (not shown) for connecting the interior of the elongated housing 7 to a vacuum cleaner (not shown), as is common in the art.

Figure 7:
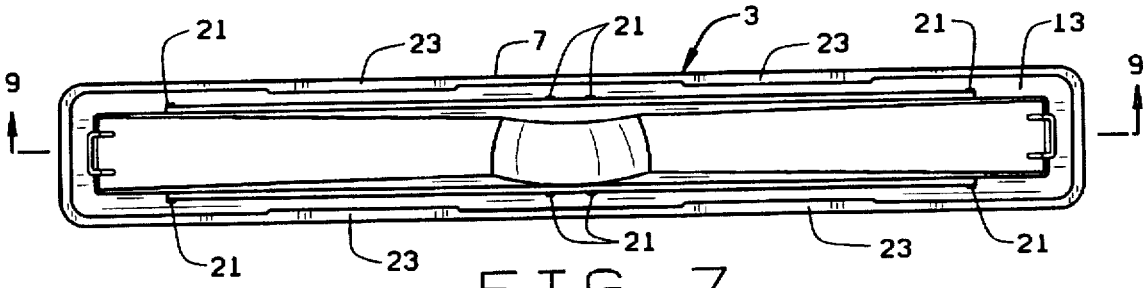
FIG. 7 is a bottom plan view of the floor brush nozzle.

Surrounding the elongated housing 7 adjacent its lower end is a U-shaped channel or opening 13. As shown in FIG. 7 of the drawings, the housing 7 has a general rectangular peripheral shape, and therefore, the U-shaped channel 13 also has a generally rectangular peripheral configuration, as well. The U-shaped channel 13 is formed by inner and outer rectangular-shaped rings 15, 17 which are connected to an integral bight end portion 19 that forms an integral part of the housing 7. It will be noted that the outer ring 15 is shorter than the inner ring 17 in order to facilitate alignment and mounting of the floor brush 5 relative to the U-shaped channel 13, as will be apparent. Preferably, the housing 7 is formed as a molded plastic component.

As explained in the introduction, the prior art used fasteners or locking elements to hold a floor brush in position in the nozzle housing. Releasable or "snap fit" engagement, up to the present invention, was not a practical option due to the large manufacturing tolerances in the upper formed end of the floor brush that retained the floor brush bristles and the nozzle housing. Since the upper formed end of the floor brush is typically formed as a U-shaped metal channel and the nozzle housing is typically formed as a molded plastic component, these large differences in manufacturing tolerances will be easily understood.

Figure 9:
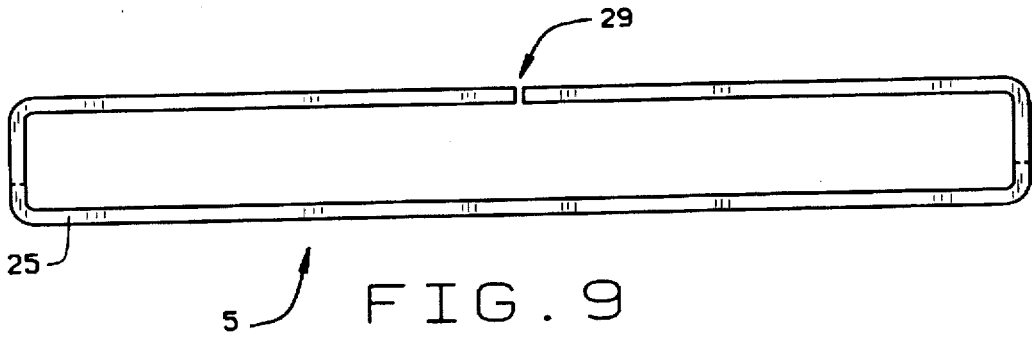
FIG. 9 is a top plan view of the floor brush showing the split section thereof.

In order to releasably mount the floor brush 5 within the U-shaped channel 13 in accordance with the present invention, the inner ring 17 includes peripherally spaced ribs 21, as best seen in FIGS. 4–8, which cooperate with peripherally spaced protuberances 23 formed in the outer ring 15 which serve as undercut areas in the U-shaped channel 13. For cooperating with the U-shaped channel 13, the floor brush 5 includes an upper U-shaped metal channel or formed end 25 formed in a generally rectangular ring-shaped configuration as shown in FIG. 9 of the drawings. The upper U-shaped metal channel 25 of the floor brush 5 has a shape generally complementary to the U-shaped channel 13 in the nozzle housing 7 and further includes undercut side areas 27 for cooperation with the peripherally spaced ribs 21 and protuberances 23 within the U-shaped channel 13. Specifically, as the upper U-shaped metal channel 25 of the floor brush 5 is inserted into the U-shaped channel, the peripherally spaced ribs 21 cause the upper molded area 25 of the floor brush 5 to releasably and resiliently engage the undercut areas of the peripherally spaced protuberances 23, in order to releasably mount the floor brush 5 relative to the nozzle housing 3. Since the upper U-shaped metal channel 25 also has undercut areas 27, releasable engagement and disengagement of the floor brush 5 relative to the U-shaped channel through the spaced ribs and protuberances 21, 23 will be enhanced.

What the present invention does is to incorporate a more forgiving tolerance design. This is done by designing the U-shaped channel 13 of the nozzle housing 7 wide enough to accommodate the U-shaped metal channel 25 of the floor brush 5 for all tolerance ranges. Then, the peripherally spaced ribs 21 are positioned far enough away from the peripherally spaced protuberances 23 forming the undercut areas in order to allow the U-shaped metal channel 25 to releasably and resiliently engage the undercut areas in order to releasably hold the floor brush 5 in the nozzle housing 7 through the entire tolerance range of the U-shaped metal channel 25 of the floor brush 5 and the complementary U-shaped channel 13 of the nozzle housing 7.

The U-shaped metal channel 25 of the floor brush 5 also includes a split section 29 which facilities circumferential contraction of the U-shaped metal channel 25 within the U-shaped channel 13 of the nozzle housing 3, to further enhance releasable engagement and disengagement.

Figure 10:
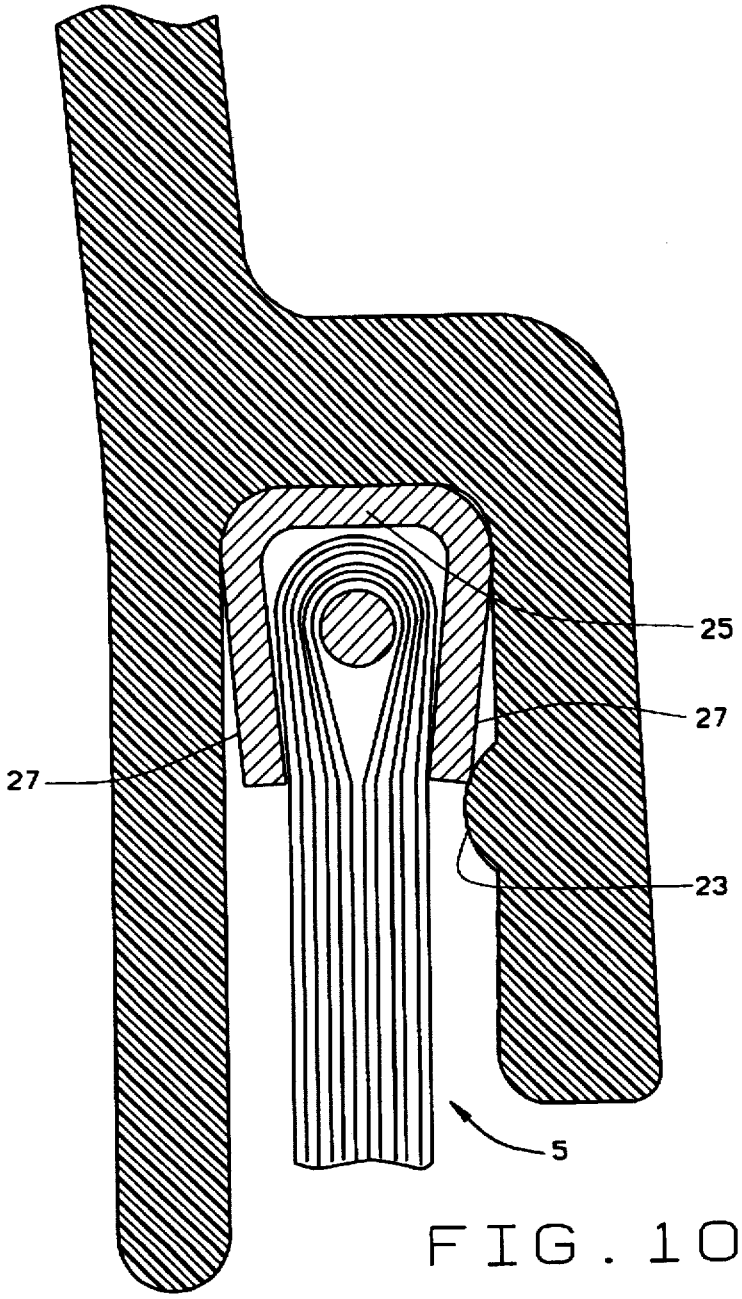
FIG. 10 is an enlarged fragmentary sectional view of a portion of the U-shaped channel of the floor brush nozzle receiving a complementary U-shaped upper formed end of the floor brush in releasable engagement.

The floor brush 5 further includes bristles having one upper end that are crimped by the U-shaped metal channel 25 of the floor brush 5, as shown best in FIG. 10. Specifically, the bristles of the floor brush 5 include shorter leading bristles 31 and longer trailing bristles 33 to facilitate pick-up of both fine debris and larger media such as rocks and wood chips. It will be appreciated that as the floor brush 5 is moved across a floor surface (not shown), the shorter leading bristles 31 will enable larger media such as rocks and wood chips to be received within the bristle area of the brush 5 for pick-up by the vacuum cleaner (not shown) through the connecting cylindrical section 11. The trailing bristles 33, on the other hand, will be useful in picking up fine debris. As shown in FIGS. 1–3, the trailing bristles 33 extend along one side and substantially along opposite ends of the nozzle housing 3, except at the leading edge where the shorter leading bristles 31 are provided, for the purposes set forth above. Thus, the floor brush 5 is able to guide smoothly along floor surfaces, while performing the aforementioned functions.

From the foregoing, it will be appreciated that the novel floor brush nozzle assembly of the present invention enables the floor brush to be snap-fit in releasable engagement within a U-shaped channel of a nozzle housing, without the need for fasteners or other locking elements. The floor brush associated with the floor brush nozzle assembly is also capable of picking up both fine debris and larger media due to shorter leading bristles and longer trailing bristles that are part of the floor brush.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

We claim:

1. A floor brush nozzle assembly for a vacuum cleaner comprising:

an elongated generally rectangular shaped nozzle housing including a connecting passageway for association with the vacuum cleaner;

a U-shaped channel surrounding said nozzle housing for receiving the complementary U-shaped upper formed end of a floor brush;

said U-shaped channel including peripherally spaced ribs that cause the complementary U-shaped upper formed end of the floor brush to releasably engage undercut areas in the U-shaped channel for maintaining of the floor brush in mounted position relative to the nozzle housing.

2. The floor brush nozzle assembly as defined in claim 1 wherein the peripherally spaced ribs are laterally offset from the undercut areas by a distance sufficient to allow the U-shaped upper formed end of the floor brush to releasably and resiliently engage the undercut areas over a wide tolerance range.

3. The floor brush nozzle assembly as defined in claim 2 wherein the nozzle housing is a molded plastic element and the U-shaped upper formed end of the floor brush is a metal channel that is crimped around one end of floor brush bristles.

4. The floor brush nozzle assembly as defined in claim 3 wherein the complementary U-shaped upper formed end of the floor brush has an undercut configuration which enhances releasable engagement with the undercut areas in the U-shaped channel of the nozzle housing.

5. The floor brush nozzle assembly as defined in claim 4 wherein the upper formed end of the floor brush includes a split section to facilitate circumferential contraction of the upper formed end when mounted within the U-shaped channel of the nozzle housing.

6. The floor brush nozzle assembly as defined in claim 5 wherein the U-shaped channel includes inner and outer rings connected by an integral bight end portion, the inner ring being longer than the outer ring.

7. The floor brush nozzle assembly as defined in claim 6 wherein the inner ring of the U-shaped channel includes the peripherally spaced ribs and the outer ring of the U-shaped channel includes the undercut areas.

8. The floor brush nozzle assembly as defined in claim 7 wherein said undercut areas in said U-shaped channel comprise peripherally spaced protuberances.

9. The floor brush nozzle assembly as defined in claim 1 wherein the floor brush includes shorter leading bristles and longer trailing bristles to facilitate pick-up of both free debris and larger media.

10. A floor brush nozzle assembly for a vacuum cleaner comprising:

an elongated generally rectangular shaped nozzle housing including a connecting passageway for association with a vacuum cleaner;

a generally vertically extending U-shaped channel of rectangular configuration surrounding said nozzle housing for receiving a complementary U-shaped upper formed end of a floor brush, said U-shaped channel including inner and outer generally rectangular shaped rings connected by an integral bight end portion;

the inner ring including peripherally spaced ribs and the outer ring including cooperating peripherally spaced protuberances for releasable and resilient engagement with the complementary U-shaped upper formed end of the floor brush;

the complementary U-shaped upper formed end of the floor brush engaging the peripherally spaced ribs and protuberances to hold the floor brush in releasable snap-fitting engagement in the U-shaped channel.

11. The floor brush nozzle assembly as defined in claim 10 wherein the complementary U-shaped upper formed end of the nozzle brush is formed from metal and the nozzle housing is formed from plastic.

12. The floor brush nozzle assembly as defined in claim 10 wherein the floor brush include shorter leading bristles and longer trailing bristles to facilitate pick-up of both free debris and larger media.

* * * * *

UNITED STATES PATENT AND TRADEMARK OFFICE

CERTIFICATE OF CORRECTION

PATENT NO. : 5,706,550

DATED : January 13, 1998

INVENTOR(S) : Stuart V. Holsten and Jeffrey L. Young

It is certified that error appears in the above-identified patent and that said Letters Patent is hereby corrected as shown below:

Column 6, Line 3
delete "free" and insert -fine-

Column 6, Line 33
delete "free" and insert -fine-

Signed and Sealed this

Ninth Day of June, 1998

*Attest:*

Bruce Lehman

BRUCE LEHMAN

*Attesting Officer*

*Commissioner of Patents and Trademarks*